US012359867B2

(12) United States Patent
Junior et al.

(10) Patent No.: US 12,359,867 B2
(45) Date of Patent: Jul. 15, 2025

(54) DOOR STORAGE ASSEMBLY

(71) Applicant: WHIRLPOOL CORPORATION, Benton Harbor, MI (US)

(72) Inventors: Adalberto B. Junior, Joinville (BR); Jackeline Furtado Laurindo, Joinville (BR); Marcel Bögger Lessa, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 181 days.

(21) Appl. No.: 18/081,940

(22) Filed: Dec. 15, 2022

(65) Prior Publication Data

US 2024/0200851 A1 Jun. 20, 2024

(51) Int. Cl.
*F25D 23/04* (2006.01)
*F25D 23/02* (2006.01)

(52) U.S. Cl.
CPC ..... *F25D 23/04* (2013.01); *F25D 23/025* (2013.01); *F25D 2331/803* (2013.01)

(58) Field of Classification Search
CPC .. F25D 23/04; F25D 2323/023; F25D 23/025; F25D 2331/803; F25D 25/025; F25D 25/027; F25D 2201/14; F25D 25/022; F25D 2331/805; F25D 2331/809; F25D 2331/812; A47B 88/48; A47B 96/16
See application file for complete search history.

(56) References Cited

U.S. PATENT DOCUMENTS 1,011,513 A * 12/1911 Spuhl ..... A47G 29/1216 248/128
2,122,501 A 7/1938 Thomas
2,361,525 A * 10/1944 Ball ..... A47B 96/16 312/274
2,944,410 A 7/1960 Mann et al.
4,186,978 A * 2/1980 Thomson ..... F25D 23/04 211/80
8,864,252 B1 * 10/2014 Rodriguez Cobas ... F25D 23/04 312/405.1
10,151,525 B2 12/2018 Shrader et al.
10,914,507 B2 * 2/2021 Karl ..... F25D 23/025
(Continued)

FOREIGN PATENT DOCUMENTS

CN 100397009 C 6/2008
JP 2009216378 A 9/2009
(Continued)

OTHER PUBLICATIONS

English translation for KR20080076116 (Year: 2008).*

*Primary Examiner* — Hiwot E Tefera
(74) *Attorney, Agent, or Firm* — Price Heneveld LLP

(57) ABSTRACT

A door storage assembly includes a housing defining an interior storage space. The housing includes sidewalls. A bin is disposed within the interior storage space. The bin is rotatably coupled to the sidewalls to rotate between a storage position and an access position. A door is coupled to the bin. The door defines slots configured to receive pins extending from the bin. A latch is coupled to the housing. The latch is configured to engage the door when the door is in a closed position. The door is configured to rotate to an opened position and the bin is configured to rotate to the access position upon release of the door from the latch.

20 Claims, 7 Drawing Sheets

(56) References Cited

U.S. PATENT DOCUMENTS

| | | | | |
|---|---|---|---|---|
| 2005/0073227 | A1* | 4/2005 | Shin | F25D 23/04 312/404 |
| 2006/0250063 | A1* | 11/2006 | Czach | A47B 88/60 312/405.1 |
| 2007/0228904 | A1* | 10/2007 | Williams | A47B 46/005 312/327 |
| 2008/0168794 | A1* | 7/2008 | Cho | F25D 25/025 62/449 |
| 2009/0026162 | A1* | 1/2009 | Kwon | F25D 25/02 211/144 |
| 2009/0223243 | A1* | 9/2009 | Lee | F25D 25/022 62/449 |
| 2014/0312758 | A1* | 10/2014 | Gossens | F25D 25/025 312/404 |
| 2017/0367478 | A1* | 12/2017 | Ahmedov | A47B 96/04 |
| 2018/0031309 | A1* | 2/2018 | Kim | F25D 25/025 |
| 2021/0285717 | A1* | 9/2021 | Gao | F25D 23/04 |

FOREIGN PATENT DOCUMENTS

| | | | | | |
|---|---|---|---|---|---|
| KR | 950002345 | Y1 | * | 3/1995 | |
| KR | 19980020016 | U | * | 7/1998 | |
| KR | 200319489 | Y1 | | 7/2003 | |
| KR | 100688208 | B1 | | 3/2007 | |
| KR | 100760403 | B1 | | 9/2007 | |
| KR | 20080076116 | A | * | 8/2008 | |
| KR | 101040795 | B1 | | 6/2011 | |
| KR | 20130038462 | A | | 4/2013 | |
| KR | 101455863 | B1 | | 11/2014 | |
| WO | 2009016506 | A2 | | 2/2009 | |
| WO | WO-2020153708 | A1 | * | 7/2020 | A47B 96/16 |

* cited by examiner

DOOR STORAGE ASSEMBLY

BACKGROUND OF THE DISCLOSURE

The present disclosure generally relates to a door storage assembly, and more specifically, to a door storage assembly for an appliance.

SUMMARY OF THE DISCLOSURE

According to one aspect of the present disclosure, a vacuum insulated refrigerated appliance includes a cabinet having an insulation cavity defined between a wrapper and a liner. An appliance door is coupled to the cabinet. The appliance door includes a structural wrapper defining an insulating cavity. Support features are coupled to an inner surface of the appliance door. A storage assembly is coupled to the support features. The storage assembly includes a housing defining an interior storage space and a bin coupled to the housing. The bin is operable between a storage position and an access position. An assembly door is coupled to the bin. The assembly door is operable between a closed position, engaging a latch on the housing, and an opened position. The bin is configured to move to the access position and the assembly door is configured to move to the opened position in response to a gravitational force when the assembly door is released from the latch.

According to another aspect of the present disclosure, a storage assembly for an appliance door includes a housing having opposing sidewalls extending from a rear wall. The housing includes hangers for engaging a door support feature. The rear wall includes a stopper extending into an interior storage space. A bin is rotatably coupled to the sidewalls of the housing. The bin is configured to rotate between a storage position and an access position. The access position is defined by an engagement of the bin with the stopper. A door has coupling brackets defining slots. Each slot is configured to receive a pin extending from the bin. The door is configured to move between a closed position and an opened position where the pins are disposed at first ends of the slots when the door is in the closed position and at second ends of the slots when the door is in the opened position.

According to yet another aspect of the present disclosure, a door storage assembly includes a housing defining an interior storage space. The housing includes sidewalls. A bin is disposed within the interior storage space. The bin is rotatably coupled to the sidewalls to rotate between a storage position and an access position. A door is coupled to the bin. The door defines slots configured to receive pins extending from the bin. A latch is coupled to the housing. The latch is configured to engage the door when the door is in a closed position. The door is configured to rotate to an opened position and the bin is configured to rotate to the access position upon release of the door from the latch.

These and other features, advantages, and objects of the present disclosure will be further understood and appreciated by those skilled in the art by reference to the following specification, claims, and appended drawings.

Figure 1:
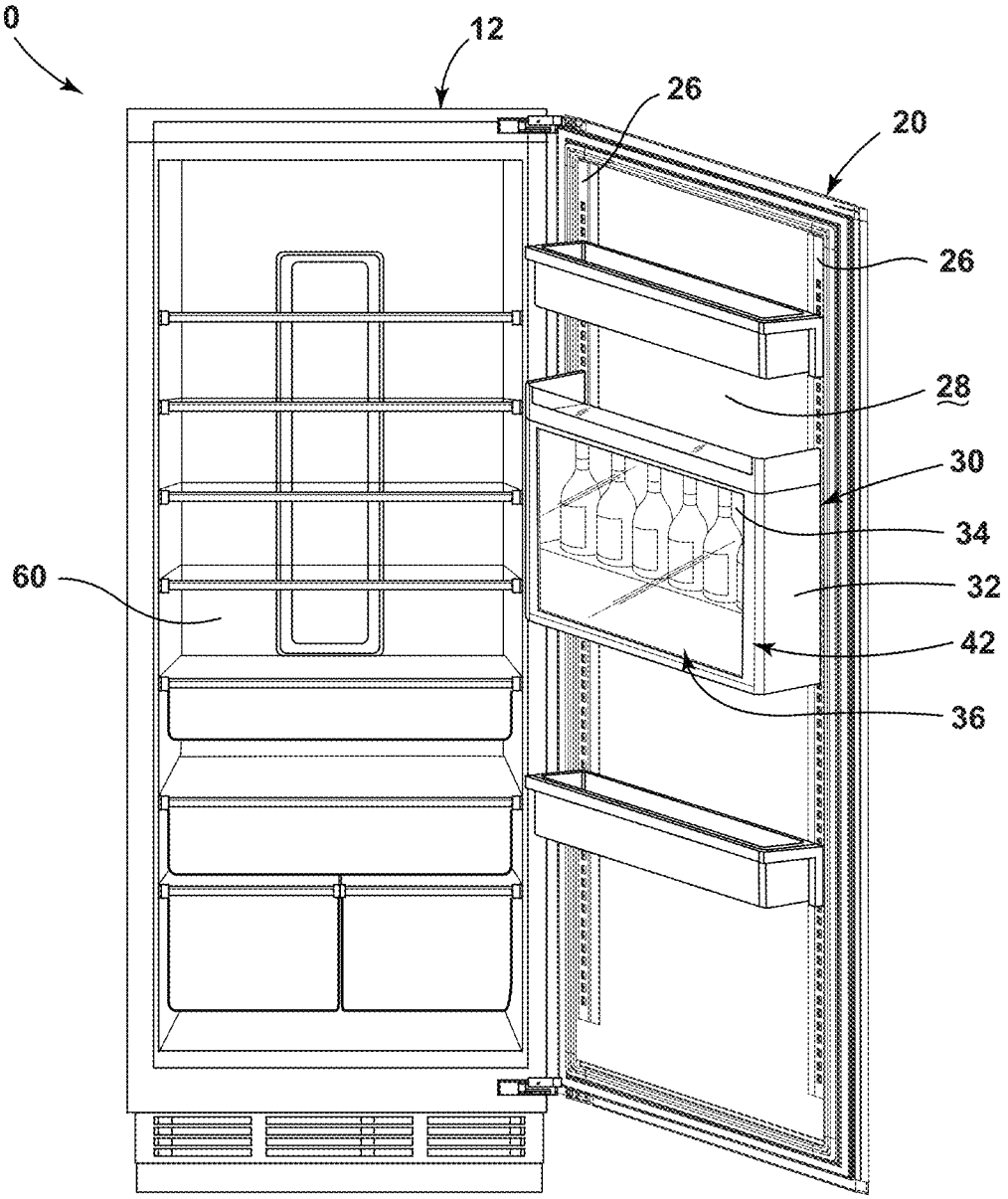
FIG. 1 is a front perspective view of an appliance with a storage assembly coupled to an inner surface of a door, according to the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a door storage assembly. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

With reference to FIGS. 1-9, reference numeral 10 generally designates a vacuum insulated refrigerated appliance 10 that includes a cabinet 12 having an insulation cavity 14 defined between a wrapper 16 and a liner 18. A door 20 is coupled to the cabinet 12. The door 20 includes a structural wrapper 22 defining an insulating cavity 24. Support features 26 are coupled to an inner surface 28 of the door 20. A storage assembly 30 is coupled to the support features 26. The storage assembly 30 includes a housing 32 defining an interior storage space 34 and a bin 36 coupled to the housing 32. The bin 36 is operable between a storage position 38 and an access position 40. The storage assembly 30 also includes a door 42 coupled to the bin 36. The door 42 is operable between a closed position 44, engaging a latch 46 on the housing 32, and an opened position 48. The bin 36 is configured to move to the access position 40 and the door 42 is configured to move to the opened position 48 in response to a gravitational force when the door 42 is released from the latch 46.

Figure 2:
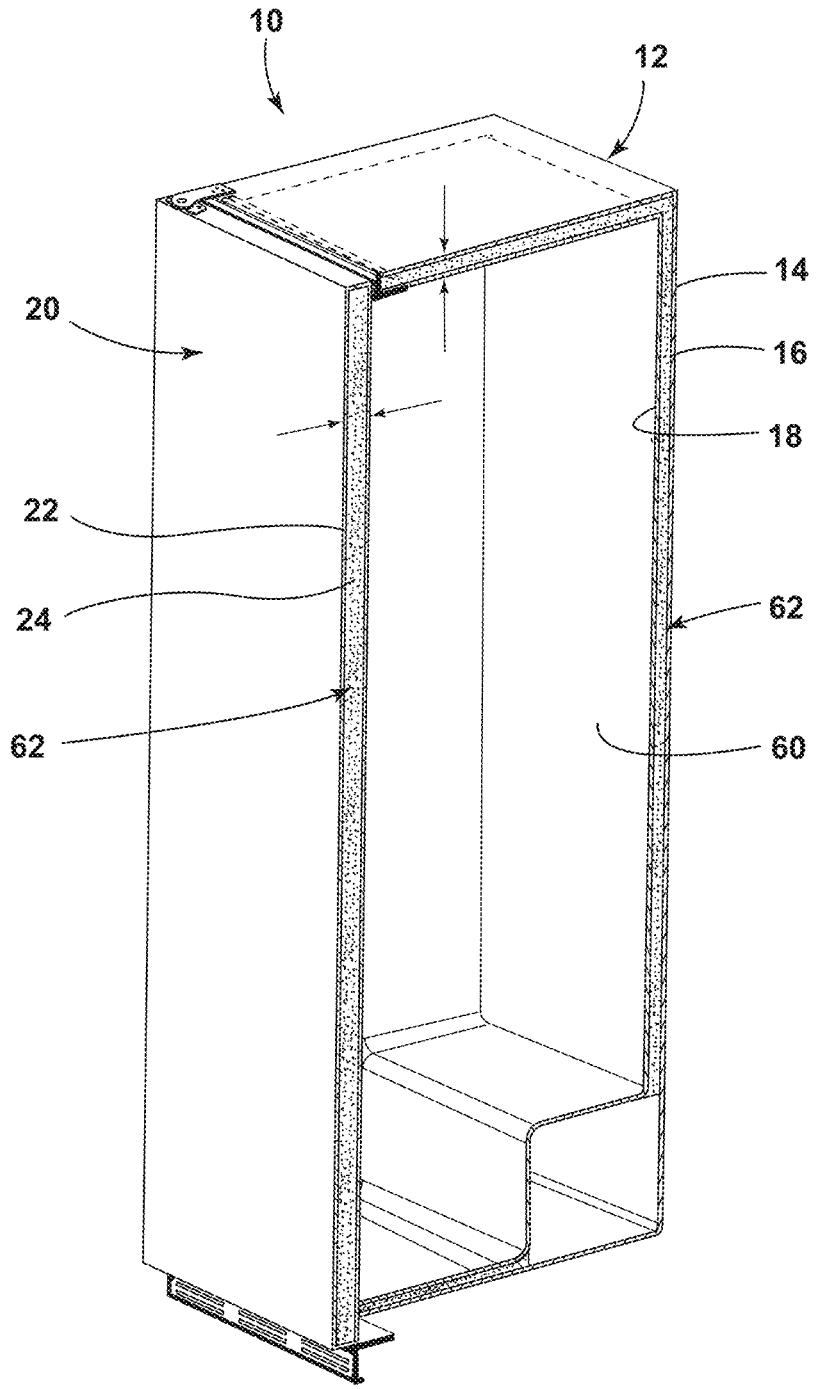
FIG. 2 is a cross-sectional view of an appliance having a vacuum insulated cabinet and a vacuum insulated door, according to the present disclosure.

Referring to FIGS. 1 and 2, the storage assembly 30 is illustrated in use on the door 20 of the refrigerated appliance 10. The storage assembly 30 may be used with any configuration of appliance 10, the door 20, other vacuum insulated structures, or other insulated structures other than appliances 10. The illustrated refrigerated appliance 10 includes a refrigeration compartment 60 and a single door 20 for accessing the refrigeration compartment 60. However, it is contemplated that the appliance 10 may include one or more refrigeration compartments 60 and freezer compartments, as well as multiple doors 20 for accessing the various compartments. Further, the doors 20 may have a variety of configurations with rotationally and/or laterally operated panels for doors 20 and drawers with various configurations, such as bottom-mount refrigerators, French-door refrigerators, top-mount refrigerators, side-by-side refrigerators, single cavity refrigerators, four-door refrigerators, five-door refrigerators, etc.

The cabinet 12 of the appliance 10 is generally an insulated structure having the wrapper 16 and the liner 18 with the insulation cavity 14 defined therebetween. The door 20 may also be vacuum insulated, forming a vacuum insulated panel. The door 20 includes the structural wrapper 22, which may be configured as a door wrapper and a door liner. The structural wrapper 22 defines the insulating cavity 24 therein.

Referring still to FIGS. 1 and 2, each of the insulating cavity 24 of the door 20 and the insulation cavity 14 of the cabinet 12 typically includes one or more insulation materials 62 disposed therein. It is generally contemplated that the insulation materials 62 may be glass-type materials, carbon-based powders, silicon oxide-based materials, silica-based materials, insulating gasses, and other standard insulation materials 62. The insulation materials 62 substantially fill the insulating cavity 24 of the door 20, forming a substantially continuous layer within the structural wrapper 22. Additionally, the insulation materials 62 substantially fill the insulation cavity 14 of the cabinet 12, forming a substantially continuous layer between the outer wrapper 16 in the inner liner 18.

The wrapper 16 and the liner 18 of the cabinet 12 and the structural wrapper 22 of the door 20 are generally constructed from a material that is at least partially resistant to bending, deformation, or otherwise being deformed in response to an inward compressive force. These materials for the wrapper 16, the liner 18, and the structural wrapper 22 may include, but are not limited to, metals, polymers, metal alloys, combinations thereof, and/or other similar substantially rigid materials that can be used for vacuum insulated structures.

An at least partial vacuum is defined within each of the insulating cavity 24 of the door 20 and the insulation cavity 14 of the cabinet 12. The at least partial vacuum defines a pressure differential between an exterior area and the insulating cavities. For the cabinet 12, the pressure differential serves to define an inward compressive force that is exerted on both the wrapper 16 and the liner 18 and tends to bias the wrapper 16 and liner 18 toward the insulation cavity 14. Similarly, for the door 20, the pressure differential serves to define the inward compressive force that is exerted on the structural wrapper 22 which tends to bias the structural wrapper 22 toward the insulating cavity 24.

Over time, gas can infiltrate the insulating cavity 24 and/or the insulation cavity 14 from an area outside of the appliance 10, which can diminish the at least partial vacuum. The infiltration of gases is sometimes referred to as gas permeation, which can result in the at least partial vacuum decreasing over time. The outer wrapper 16 defines an evacuation port, providing an opening into the insulation cavity 14, and the structural wrapper 22 defines an evacuation port, providing an opening into the insulating cavity 24. The at least partial vacuum is typically defined by evacuation of the door 20 and the cabinet 12 through the respective evacuation ports to expel gas from the insulating cavity 24 and insulation cavity 14, respectively. While described herein as the vacuum insulated appliance 10 with the vacuum insulated door 20, the storage assembly 30 may be used with appliances 10 or doors 20 having other types of insulation, without departing from the teachings herein.

Figure 3:
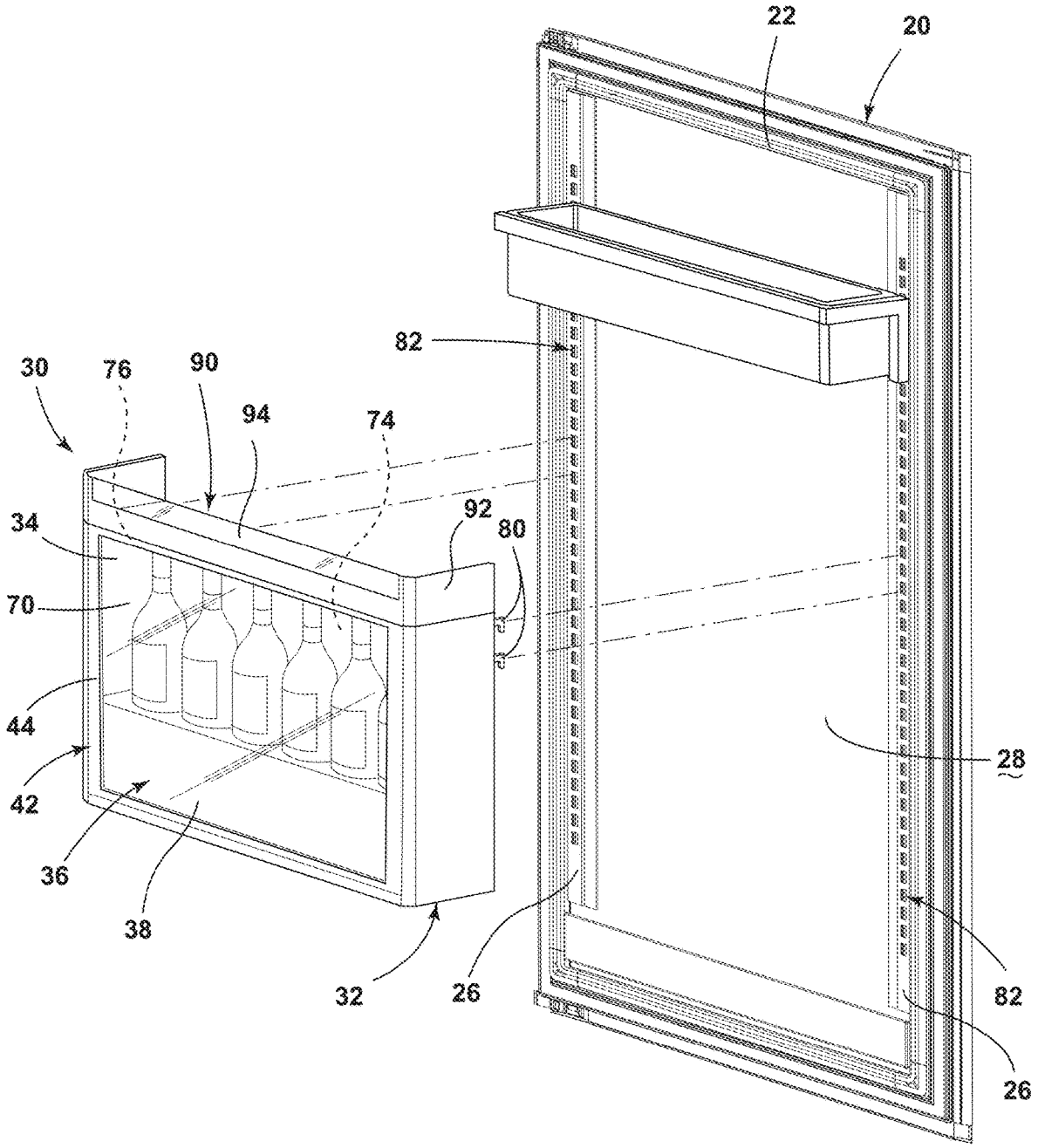
FIG. 3 is a side perspective partially exploded view of a door with a storage assembly, according to the present disclosure.

Referring to FIG. 3, the storage assembly 30 is configured to couple to the support features 26 on the door 20. Generally, the support features 26 are configured as ladder racks coupled to the inner surface 28 of the door 20. The support features 26 may engage the inner surface 28 of the structural wrapper 22 and may not pierce the structural wrapper 22 to maintain the at least partial vacuum in the insulating cavity 24.

The storage assembly 30 includes the housing 32 having sidewalls 70, 72 extending from a rear wall 74 and an upper wall 76 extending between the sidewalls 70, 72 and over the interior storage space 34. Hangers 80 are coupled to the housing 32 and extend away from the interior storage space 34 toward the inner surface 28 of the door 20. The hangers 80 are generally configured to engage the support features 26, such as by extending through apertures 82 defined by the support features 26. The hangers 80 allow the storage assembly 30 to be supported by or hang on the support features 26. The rear wall 74 of the housing 32 may at least partially abut the inner surface 28 of the door 20. Additionally or alternatively, the rear wall 74 may abut the storage features and be spaced from the inner surface 28. The engagement between the rear wall 74 and the inner surface 28 and/or the support features 26 may provide additional support or stability to the storage assembly 30.

Referring still to FIG. 3, the storage assembly 30 includes multiple storage spaces. The storage assembly 30 defines the interior storage space 34 with the bin 36 and a shelf area 90. The shelf area 90 is defined above and/or over the interior storage space 34 and is separate from the interior storage space 34 by the upper wall 76. An upper surface of the upper wall 76 is configured to support items thereon forming the shelf area 90.

The housing 32 includes a retaining member 92 that extends along at least a portion of a perimeter of the upper wall 76. Generally, the retaining member 92 extends along three edges of the upper wall 76 with the inner surface 28 of the door 20 providing the retaining aspect along a fourth edge. The retaining member 92 extends vertically from the upper wall 76 and extends away from the interior storage space 34 to define the shelf area 90. The retaining member 92 is configured to assist with retaining items disposed on the upper wall 76.

The retaining member 92 may include a viewing portion 94, which may be substantially transparent or clear. The viewing portion 94 may be advantageous for viewing labels on items stored in the shelf area 90 without having to remove the items from the shelf area 90 or otherwise adjust the items. In the illustrated example of FIG. 3, the viewing portion 94 extends parallel to the inner surface 28 of the door 20. However, other configurations of the retaining member 92 and the viewing portion 94 are contemplated without departing from the teachings herein.

Figure 4:
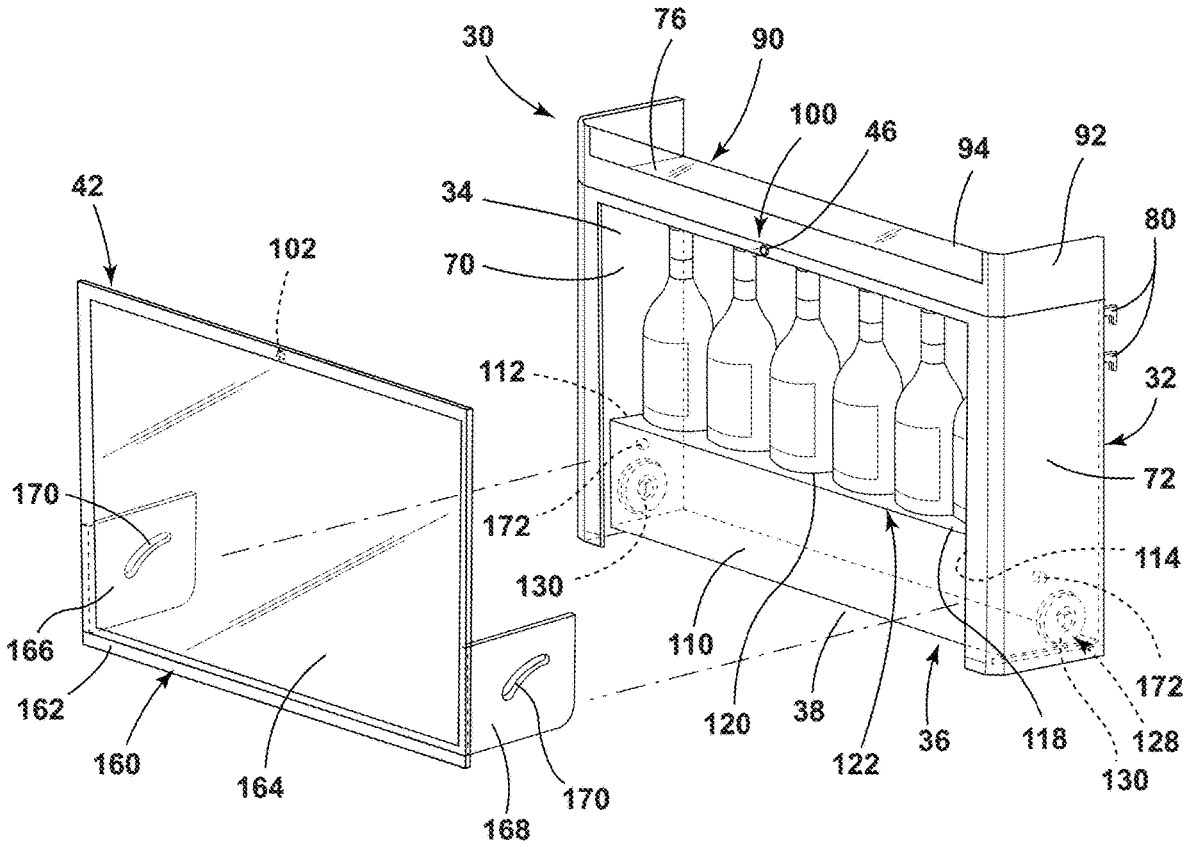
FIG. 4 is a side perspective partially exploded view of a storage assembly, according to the present disclosure.
Figure 5:
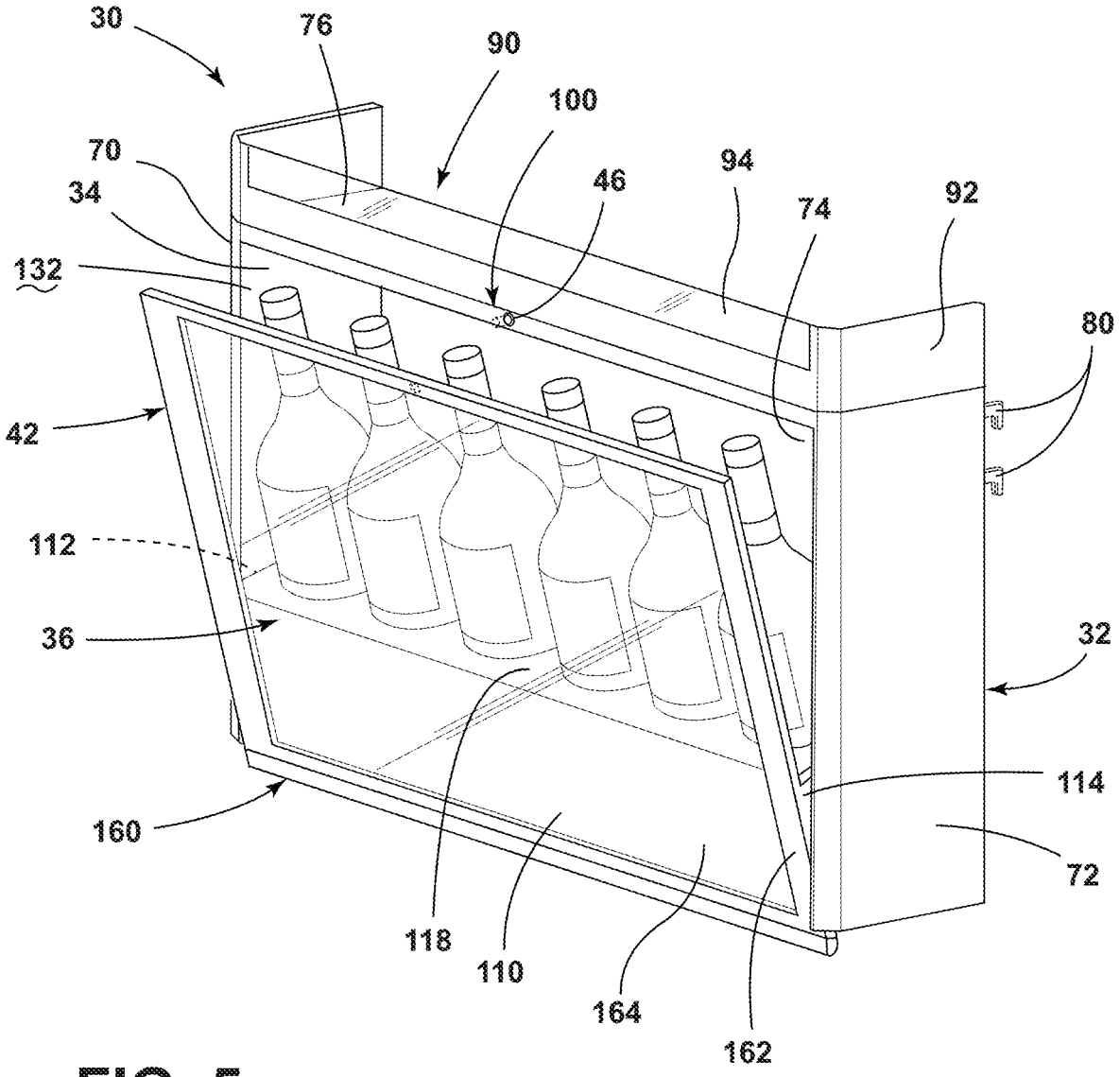
FIG. 5 is a side perspective view of a storage assembly with a door in a partially opened position, according to the present disclosure.

Referring to FIGS. 4 and 5, the storage assembly 30 includes the door 42, which is configured to selectively enclose and provide access to the interior storage space 34. The storage assembly 30 includes a lock assembly 100 including the latch 46 on the housing 32 and a lock feature 102 on the door 42. The housing 32 includes the latch 46 on the upper wall 76, and the lock feature 102 is configured to align with and engage the latch 46 when the door 42 is in the closed position 44. In various aspects, the lock feature 102 may be configured to mate with the latch 46.

The lock assembly 100 is configured to retain the door 42 in the closed position 44, which is generally a vertical position. The lock assembly 100 may be configured as a push-push lock. In this way, a user may push or press the door 42 toward the housing 32 to lock the lock assembly 100, retaining the door 42 in the closed position 44, and again push the door 42 toward the housing 32 to release the lock feature 102 from the latch 46, allowing the door 42 to open. The lock assembly 100 is illustrated in an upper center location of the storage assembly 30 but may be disposed in any practicable location for selectively retaining and releasing the door 42.

Figure 6:
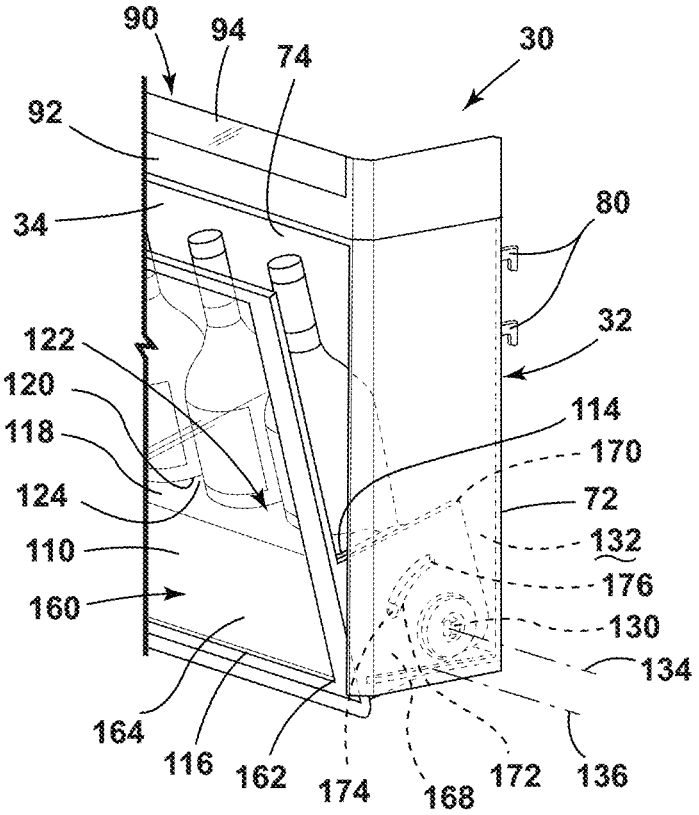
FIG. 6 is a partial side perspective view of a storage assembly with a door in a partially opened position, where the door defines a slot for engaging a pin, according to the present disclosure.

Referring to FIG. 6, the storage assembly 30 may be configured for storing beverages, bottles, cans, etc. within the bin 36 in the interior storage space 34. The bin 36 includes an outer support 110 extending between the sidewalls 70, 72 of the housing 32. The bin 36 also has two sides 112, 114 extending from opposing edges of the outer support 110 proximate and parallel to the sidewalls 70, 72 of the housing 32. Additionally, the bin 36 includes a base 116 for supporting items thereon and an upper holder 118 for providing additional support to items in the bin 36. The upper holder 118 extends parallel to the base 116 and between the two sides 112, 114 of the bin 36. The upper holder 118 defines grooves 120 for forming receiving areas 122 for bottles and other similarly shaped items. The upper holder 118 also includes dividers 124 between adjacent grooves 120 and, consequently, adjacent receiving areas 122, to further reduce movement of the bottles in the bin 36.

The bin 36 is rotatably coupled to the sidewalls 70, 72 of the housing 32. In various aspects, rotation members 128 are configured to engage the sides 112, 114 of the bin 36 and the sidewalls 70, 72 of the housing 32 to guide rotation of the bin 36. In various aspects, the rotation members 128 are configured as rotary dampers 130 coupled to an inside surface 132 of the sidewalls 70, 72. Accordingly, the bin 36 is coupled to the housing 32 via the rotary dampers 130.

The rotary dampers 130 are configured to allow for rotation of the bin 36 between the storage position 38 and the access position 40 about a rotational axis 134 defined by the rotary dampers 130. The sides 112, 114 of the bin 36 may define apertures or other engagement features for receiving and/or engaging the rotary dampers 130. The rotary dampers 130 are configured to maintain a connection with both the sides 112, 114 of the bin 36 and the sidewalls 70, 72 of the housing 32, respectively. Moreover, the rotary dampers 130 are configured to control and/or slow the rotation of the bin 36. It is also contemplated that the rotary dampers 130 may be coupled to the bin 36 and engage features of the sidewalls 70, 72 without departing from the teachings herein.

Referring still to FIG. 6, the rotary dampers 130 are coupled to the bin 36 proximate to rear edges of the sides 112, 114 and the base 116 proximate to the rear wall 74. Accordingly, the rotational axis 134 of the bin 36 is defined in a lower, inner corner of the bin 36, which is offset from a center of mass 136 of the bin 36. This rotational axis 134 is offset and off-center from the center of mass 136 of the bin 32 The offset or off-center positioning of the rotational axis 134 relative to the center of mass 136 is advantageous for promoting the rotation of the bin 36 in response to the gravitational forces, as described herein.

Figure 7:
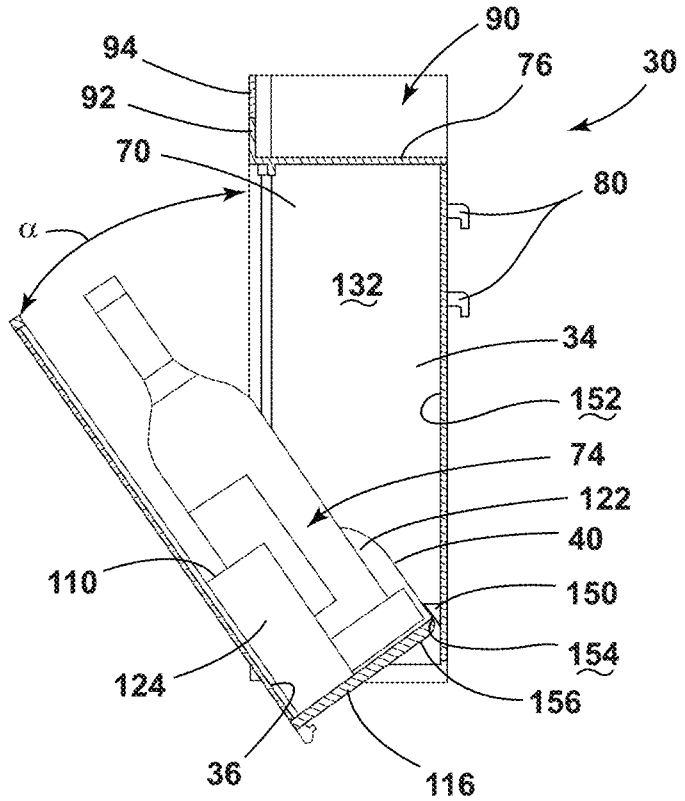
FIG. 7 is a cross-sectional view of a storage assembly with a bin in an access position engaging a stopper, according to the present disclosure.

Referring still to FIG. 6, as well as FIG. 7, the bin 36 is configured to rotate from the storage position 38 and the access position 40. The storage position 38 is generally an upright or vertical position where the bin 36 is substantially or fully disposed between the sidewalls 70, 72 of the housing 32 in the interior storage space 34. In the access position 40, the bin 36 is disposed at an acute angle relative to the storage position 38. The bin 36 is disposed partially between the sidewalls 70, 72 of the housing 32 and extends partially outside of the interior storage space 34. The bin 36 is generally configured to rotate a first degree of rotation $\alpha$ between the storage position 38 and the access position 40. The first degree of rotation $\alpha$ defines the acute angle, which is generally between about 15° and about 35° from the storage position 38.

The housing 32 includes a stopper 150 coupled to and extending from an inner surface 152 of the rear wall 74. In this way, the stopper 150 extends into the interior storage space 34 toward the bin 36. The stopper 150 is generally wedge-shaped defining an angled abutting surface 154, which extends at an obtuse angle relative to the inner surface 152 of the rear wall 74.

An inner edge 156 of the base 116 of the bin 36 is configured to engage the abutting surface 154 of the stopper 150 to stop the rotation of the bin 36 and to retain the bin 36 in the access position 40. While the stopper 150 is configured to stop the rotation of the bin 36 after the bin 36 has rotated the first degree of rotation $\alpha$, the stopper 150 does not substantially impinge on the rotation until the bin 36 reaches the access position 40. Accordingly, the bin 36 has generally free rotation, controlled by the rotary dampers 130, between the storage position 38 and the access position 40.

Figure 8:
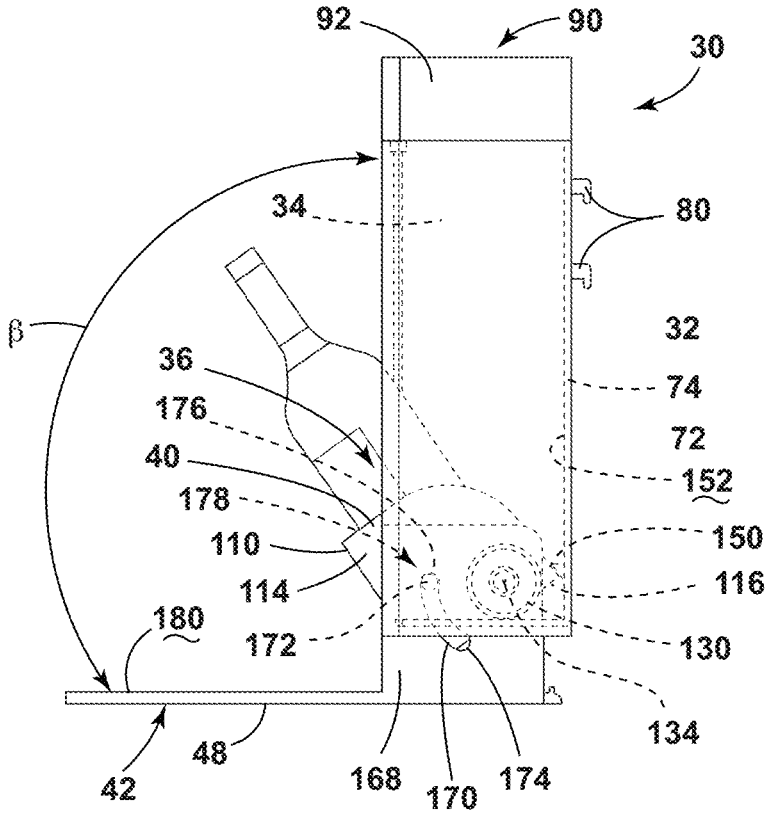
FIG. 8 is a side plan view of a storage assembly with a bin in an access position and a door in an opened position, according to the present disclosure.
Figure 9:
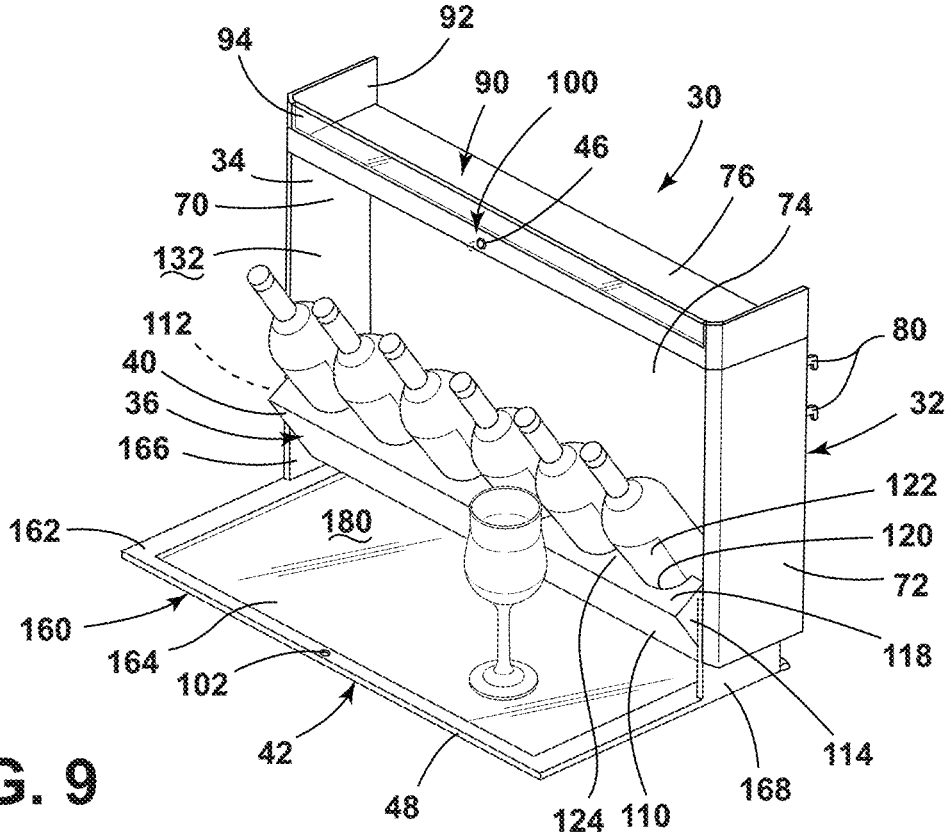
FIG. 9 is a side perspective view of a storage assembly with a bin in an access position and a door in an opened position to provide a support surface, according to the present disclosure.

Referring to FIGS. 8 and 9, the door 42 includes a panel 160 having a frame 162 and a window 164. The frame 162 extends along a perimeter of the window 164 and includes the lock feature 102. The window 164 may permit viewing of the interior storage space 34 when the door 42 is in the closed position 44. The door 42 includes coupling brackets 166, 168 extending generally perpendicular from the frame 162 and into the interior storage space 34. The brackets 166, 168 are configured to couple the door 42 to the bin 36 and/or the housing 32. In various aspects, the rotary dampers 130 extend through the brackets 166, 168. The rotary dampers 130 may assist in controlling the movement of the door 42. In such examples, the rotary dampers 130 may be configured to control and slow rotation of the door 42. It is also contemplated that the rotary dampers 130 may extend through the brackets 166, 168 without affecting the rotation of the door 42.

The brackets 166, 168 each define a slot 170, which generally have arced shapes. The bin 36 includes pins 172 that extend from the sides 112, 114 towards the sidewalls 70, 72 of the housing 32. The pins 172 are received within the slots 170 to couple the bin 36 with the door 42. The door 42 is configured to move to the opened position 48, while the bin 36 is in the access position 40 based on the movement of the slots 170 relative to the pins 172. In this way, the engagement between the slots 170 and the pins 172 defines at least a portion of the movement path of the door 42. When the door 42 is in the closed position 44, the pins 172 are positioned at first ends 174 of the slots 170, and when the door 42 is in the opened position 48, the pins 172 are disposed at second opposing ends 176 of the slots 170. The pins 172 disposed at the second ends 176 of the slots 170 act as a second stopper 178 for stopping the rotation of the door 42 and retaining the door 42 in the opened position 48.

Referring still to FIGS. 8 and 9, the bin 36 forms the bottom or floor of the interior storage space 34 and the storage assembly 30. This configuration of the open-bottomed housing 32 allows for the rotation of the bin 36 without being impeded by an additional floor. Further, the bin 36 forming the floor of the storage assembly 30 allows for rotation of the door 42 to the opened position 48 where the door 42 partially extends below the housing 32. In the opened position 48, the door 42 is configured to be disposed partially below the bin 36 and the housing 32 adjacent to the inner surface 28 of the door 42.

The door 42 is configured to rotate from the closed position 44, which is substantially vertical, to the opened position 48, which is substantially horizontal and generally perpendicular to the inner surface 28 of the door 42. The door 42 is configured to rotate a second degree of rotation $\beta$, which is greater than the first degree of rotation $\alpha$. The second degree of rotation $\beta$ is about 90° (i.e., a second angle $\beta$) relative to the closed position 44. When rotating or moving between the closed and opened positions 44, 48, the door 42 is configured to move along the arcuate path due to the arced slots 170 moving relative to the pins 172 on the bin 36.

With reference still to FIGS. 8 and 9, in various aspects, the door 42 is configured to rotate with the bin 36 about the rotational axis 134 for the first degree of rotation $\alpha$ and then continue to move along the arced path as the bin 36 remains in the access position 40. Accordingly, the door 42 is configured to rotate with the bin 36 and then continue to rotate up to the second degree of rotation $\beta$ after the bin 36 is stopped in the access position 40. In such examples, the pins 172 remain at the first ends 174 of the slots 170 until the bin 36 reaches the access position 40 and then the slots 170 adjust relative to the pins 172 until the pins 172 are at the second ends 176. Alternatively, the door 42 may move differently than the bin 36 for the first degree of rotation $\alpha$. In such examples, the slots 170 begin to move relative to the pins 172 before the bin 36 reaches the access position 40.

When the door 42 is in the opened position 48, the door 42 provides a generally horizontal support surface 180. When the bin 36 is in the access position 40, the bin 36 is configured to "present" the bottles in the bin 36, providing increased access to the items in the bin 36. The bin 36 and door 42 configuration may provide presentation of bottles and the surface 180 to support glasses. For example, a glass or cup may be positioned on the support surface 180 while the user takes a bottle from the bin 36 to pour the beverage into the glass. The storage assembly 30 then provides storage, presentation, and a tray or table surface 180 for the items in the bin 36.

Referring again to FIGS. 1-9, the bin 36 and the door 42 of the storage assembly 30 are configured to automatically rotate to subsequent positions upon release of the door 42 from the latch 46. This automatic rotation is generally a result of gravitational forces, weight of the bin 36, weight of items in the bin 36, and weight of the door 42, as well as the off-center rotational axis 134 of the bin 36. The off-center rotational axis 134, closer to the rear wall 74 than the door 42, assists in facilitating the automatic rotation of the bin 36 and the door 42.

The items in the bin 36 may be accessed and removed from the bin 36 when the bin 36 is in the storage position 38 and when the bin 36 is in the access position 40. The access position 40 may present the items in the bin 36 and provide for more ergonomic grasping of the item. Additionally, while the bin 36 is illustrated as having grooves 120 and dividers 124 for supporting bottles, it is contemplated that other configurations of the bin 36 may be utilized with the storage assembly 30. In this way, other types of items may be supported in the bin 36. Further, when the beverages are being presented due to the bin 36 being in the access position 40, the door 42 provides the support surface 180 configured to be utilized as a tray to place containers and to serve beverages.

In operation, the user may open the door 20 of the appliance 10 to access the storage assembly 30. The user may adjust the position of the storage assembly 30 along the support features 26 by removing and re-engaging the hangers 80 along a height or a width of the support features 26 depending on the configuration of the support features 26 along the inner surface 28 of the door 20. The user may access items stored in the upper shelf area 90 on the upper wall 76 of the storage assembly 30.

The user may press the door 42 towards the housing 32 (e.g., apply force towards the inner surface 28 of the door 42). Generally, the user may press an upper center area of the door 42 proximate to the lock feature 102 to push the door 42 toward the latch 46 to disengage the door 42 from the latch 46. Upon release of the door 42 from the latch 46, the gravitational forces, weights of various components (e.g., the bin 36, the door 42, and items in the bin 36), and the off-center rotational axis 134 facilitate automatic rotation of the bin 36 and the door 42. The bin 36 and the door 42 begin rotating from the storage position 38 and the closed position 44, respectively, about the off-center rotational axis 134 and away from the inner surface 28 of the door 42. The bin 36 and the door 42 continue to rotate until the bin 36 engages the stopper 150 after the first degree of rotation $\alpha$, which retains the bin 36 in the angled access position 40.

The door 42 is configured to continue to rotate along the arcuate path, moving the slots 170 defined in the brackets 166, 168 relative to the pins 172 of the door 42. In this way, the door 42 continues to rotate the second degree of rotation $\beta$ until the pins 172 are at the second ends 176 of the slots 170 acting as stoppers 178. The door 42 is retained in the opened position 48 by the engagement between the pins 172 and the slots 170 to provide the horizontal support surface 180 or tray. It is contemplated that the bin 36 and the door 42 may move generally together until the bin 36 reaches the access position 40. Alternatively, the door 42 may rotate independently of the bin 36. As the door 42 and the bin 36 rotate, the rotary dampers 130 are configured to control and slow rotation of the bin 36.

To return the storage assembly 30 to the closed state, the user is configured to rotate the door 42 toward the closed position 44. As the door 42 rotates, the inner surface 28 of the door 42 will abut or engage the outer support 110 of the bin 36. The movement of the door 42 pushes or causes the rotation of the bin 36 back toward the storage position 38. The user may then press the door 42 against the latch 46 to reengage the latch 46 retaining the door 42 in the closed position 44 and the bin 36 in the storage position 38.

Use of the present device may provide for a variety of advantages. For example, the storage assembly 30 may be used on vacuum insulated doors 20, maintaining the vacuum insulated cavity within the door 20. Further, the storage assembly 30 provides multiple storage spaces, including the upper shelf area 90, the interior storage space 34, and the support surface 180 formed by the door 42. Moreover, the bin 36 and the door 42 are configured to automatically rotate upon release of the door 42, with rotation being slowed or dampened by the rotation members 128 (e.g., the rotary dampers 130). Further, the access position 40 of the bin 36 provides ergonomic access to the items within the bin 36, such as bottles, and presents the items in the bin 36 to the user. Accordingly, the storage assembly 30 may be configured as a beverage compartment. Additionally, the door 42 of the storage assembly 30 provides the tray or support surface 180 for items, which may relate to the items within the storage bin 36, such as glasses or cups. Moreover, the bin 36 may define grooves 120 and dividers 124 for supporting and further stabilizing bottles and similarly shaped items during rotation of the bin 36. Additional benefits and/or advantages may be realized and/or achieved.

The device disclosed herein is further summarized in the following paragraphs and is further characterized by combinations of any and all of the various aspects described therein.

According to an aspect of the present disclosure, a vacuum insulated refrigerated appliance includes a cabinet having an insulation cavity defined between a wrapper and a liner. An appliance door is coupled to the cabinet. The appliance door includes a structural wrapper defining an insulating cavity. Support features are coupled to an inner surface of the appliance door. A storage assembly is coupled to the support features. The storage assembly includes a housing defining an interior storage space and a bin coupled to the housing. The bin is operable between a storage position and an access position. An assembly door is coupled to the bin. The assembly door is operable between a closed position, engaging a latch on the housing, and an opened position. The bin is configured to move to the access position and the assembly door is configured to move to the opened position in response to a gravitational force when the assembly door is released from the latch.

According to another aspect, a housing includes an upper wall that extends over an interior storage space. A retaining member extends along at least a portion a perimeter of the upper wall to form a shelf area on the upper wall.

According to yet another aspect, a bin is coupled to a housing via rotary dampers. The rotary dampers are off-center relative to a center of mass of the bin.

According to another aspect, rotary dampers are coupled to a bin proximate to a rear wall of a housing to facilitate rotation of the bin in response to a gravitational force.

According to yet another aspect, a bin includes a holder that defines grooves for supporting bottles.

According to another aspect, a housing includes a stopper. A base of a bin is configured to engage the stopper to stop movement of the bin and to retain the bin in an access position.

According to yet another aspect, an assembly door defines slots that are configured to receive pins that extend from a bin. The assembly door is configured to move relative to the bin by adjusting the slots relative to the pins.

According to another aspect of the present disclosure, a storage assembly for an appliance door includes a housing having opposing sidewalls extending from a rear wall. The housing includes hangers for engaging a door support feature. The rear wall includes a stopper extending into an interior storage space. A bin is rotatably coupled to the sidewalls of the housing. The bin is configured to rotate between a storage position and an access position. The access position is defined by an engagement of the bin with the stopper. A door has coupling brackets defining slots. Each slot is configured to receive a pin extending from the bin. The door is configured to move between a closed position and an opened position where the pins are disposed at first ends of the slots when the door is in the closed position and at second ends of the slots when the door is in the opened position.

According to yet another aspect, a bin is configured to rotate a first degree of rotation from a storage position to an access position. A door is configured to rotate a second degree of rotation from a closed position to an opened position. The second degree of rotation is greater than the first degree of rotation.

According to another aspect, a first degree of rotation defines an acute angle for providing increased access to a bin. A second degree of rotation is 90 degrees from a closed position to an opened position to provide a support surface.

According to yet another aspect, a latch is coupled to a housing and is configured to engage a door. A bin and the door are configured to rotate in response to a gravitational force when the door is released from the latch.

According to another aspect, an inner edge of a base of a bin engages an angled abutting surface of a stopper in an access position.

According to yet another aspect, a housing includes an upper wall that extends over an interior storage space. A retaining member is coupled to the upper wall to define a shelf area above the interior storage space.

According to another aspect, a bin defines grooves for receiving bottles.

According to yet another aspect of the present disclosure, a door storage assembly includes a housing defining an interior storage space. The housing includes sidewalls. A bin is disposed within the interior storage space. The bin is rotatably coupled to the sidewalls to rotate between a storage position and an access position. A door is coupled to the bin. The door defines slots configured to receive pins extending from the bin. A latch is coupled to the housing. The latch is configured to engage the door when the door is in a closed position. The door is configured to rotate to an opened position and the bin is configured to rotate to the access position upon release of the door from the latch.

According to another aspect, a rotational axis of a bin is offset from a center of mass of the bin. The bin is configured to rotate in response to a gravitational force and based on the offset position of the rotational axis.

According to yet another aspect, a bin is configured to rotate a first degree of rotation with a door. The bin is configured to engage a stopper at an access position.

According to another aspect, a door is configured to move to an opened position by moving slots relative to pins when a bin is in an access position.

According to yet another aspect, a housing includes a first stopper for engaging a bin in an access position. An engagement between slots and pins defines a second stopper for retaining a door in an opened position.

According to another aspect, a door is configured to move along an arced path to an opened position to provide a horizontal support surface.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A vacuum insulated refrigerated appliance, comprising:

a cabinet having an insulation cavity defined between a wrapper and a liner;

an appliance door coupled to the cabinet, wherein the appliance door includes a structural wrapper defining an insulating cavity;

support features coupled to an inner surface of the appliance door; and a storage assembly coupled to the support features, wherein the storage assembly includes:

a housing defining an interior storage space, the housing having opposing sidewalls extending from a rear wall, wherein the rear wall includes a stopper extending into the interior storage space;

a bin rotatably coupled to the opposing sidewalls of the housing, wherein the bin is operable between a storage position and an access position, wherein the access position is defined by engagement of the bin with the stopper; and an assembly door coupled to the bin and having coupling brackets defining slots configured to receive pins extending from the bin, the assembly door operable between a closed position engaging a latch on the housing and an opened position, wherein the bin is configured to move to the access position and the assembly door is configured to move to the opened position in response to a gravitational force when the assembly door is released from the latch, the pins being disposed at first ends of the slots when the door is in the closed position and second ends of the slots when the door is in the opened position.

2. The vacuum insulated refrigerated appliance of claim 1, wherein the housing includes an upper wall extending over the interior storage space, and wherein a retaining member extends along at least a portion a perimeter of the upper wall to form a shelf area on the upper wall.

3. The vacuum insulated refrigerated appliance of claim 1, wherein the bin is coupled to the housing via rotary dampers, and wherein the rotary dampers are off-center relative to a center of mass of the bin.

4. The vacuum insulated refrigerated appliance of claim 3, wherein the rotary dampers are coupled to the bin proximate to the rear wall of the housing to facilitate rotation of the bin in response to the gravitational force.

5. The vacuum insulated refrigerated appliance of claim 1, wherein the bin includes a holder defining grooves for supporting bottles.

6. The vacuum insulated refrigerated appliance of claim 1, wherein a base of the bin is configured to engage the stopper to stop movement of the bin and retain the bin in the access position.

7. A storage assembly for an appliance door, comprising:

a housing having opposing sidewalls extending from a rear wall, wherein the housing includes hangers for engaging a door support feature, and wherein the rear wall includes a stopper extending into an interior storage space;

a bin rotatably coupled to the opposing sidewalls of the housing, wherein the bin is configured to rotate between a storage position and an access position, and wherein the access position is defined by engagement of the bin with the stopper; and a door having coupling brackets defining slots, wherein each slot is configured to receive a pin extending from the bin, and wherein the door is configured to move between a closed position and an opened position, the pins being disposed at first ends of the slots when the door is in the closed position and second ends of the slots when the door is in the opened position.

8. The storage assembly of claim 7, wherein the bin is configured to rotate a first degree of rotation from the storage position to the access position, and wherein the door is configured to rotate a second degree of rotation from the closed position to the opened position, the second degree of rotation being greater than the first degree of rotation.

9. The storage assembly of claim 8, wherein the first degree of rotation defines an acute angle for providing increased access to the bin, and wherein the second degree of rotation is 90 degrees from the closed position to the opened position to provide a support surface.

10. The storage assembly of claim 7, further comprising:

a latch coupled to the housing and configured to engage the door, wherein the bin and the door are configured to rotate in response to a gravitational force when the door is released from the latch.

11. The storage assembly of claim 7, wherein an inner edge of a base of the bin engages an angled abutting surface of the stopper in the access position.

12. The storage assembly of claim 7, wherein the housing includes an upper wall extending over the interior storage space, and wherein a retaining member is coupled to the upper wall to define a shelf area above the interior storage space.

13. The storage assembly of claim 7, wherein the bin defines grooves for receiving bottles.

14. A door storage assembly, comprising:

a housing defining an interior storage space, wherein the housing includes sidewalls and hangers for engaging a door support feature;

a bin disposed within the interior storage space, wherein the bin is rotatably coupled to the sidewalls to rotate between a storage position and an access position;

a door coupled to the bin, wherein the door defines slots configured to receive pins extending from the bin; and a latch coupled to the housing, wherein the latch is configured to engage the door when the door is in a closed position, and wherein the door is configured to rotate to a first degree of rotation in a first direction to an opened position and the bin is configured to rotate a second lesser degree of rotation in the first direction to the access position upon release of the door from the latch and in response to a gravitational force.

15. The door storage assembly of claim 14, wherein a rotational axis of the bin is offset from a center of mass of the bin, and wherein the bin is configured to rotate in response to the gravitational force and based on an offset position of the rotational axis.

16. The door storage assembly of claim 14, wherein the bin is configured to rotate the second lesser degree of rotation with the door, and wherein the bin is configured to engage a stopper at the access position.

17. The door storage assembly of claim 16, wherein the door is configured to move to the opened position by moving the slots relative to the pins when the bin is in the access position.

18. The door storage assembly of claim 14, wherein the housing includes a first stopper for engaging the bin in the access position, and wherein an engagement between the slots and the pins defines a second stopper for retaining the door in the opened position.

19. The door storage assembly of claim 14, wherein the door is configured to move along an arced path to the opened position to provide a horizontal support surface.

20. The door storage assembly of claim 14, wherein the pins are disposed at first ends of the slots when the door is in the closed position and second ends of the slots when the door is in the opened position.

* * * * *